US007045112B2

(12) United States Patent
Park et al.

(10) Patent No.: US 7,045,112 B2
(45) Date of Patent: May 16, 2006

(54) METHOD OF MAKING MANGANESE SULFIDE COMPOSITIONS

(75) Inventors: Dong Kyu Park, Pusan-kwangyokshi (KR); Hyung Bum Kim, Kyongsangnam-do (KR)

(73) Assignee: Kaya Ama Inc., Kyoungsangnam-Do (KR)

( * ) Notice: Subject to any disclaimer, the term of this patent is extended or adjusted under 35 U.S.C. 154(b) by 0 days.

(21) Appl. No.: 11/121,646

(22) Filed: May 4, 2005

(65) Prior Publication Data

US 2005/0211021 A1 Sep. 29, 2005

Related U.S. Application Data

(62) Division of application No. 10/219,026, filed on Aug. 14, 2002, now abandoned.

(30) Foreign Application Priority Data

Nov. 30, 2001 (KR) ..... 2001-0075389

(51) Int. Cl.
*C01G 1/12* (2006.01)
*C01G 45/00* (2006.01)

(52) U.S. Cl. ..... 423/561.1; 423/61; 423/267; 423/275

(58) Field of Classification Search ..... 423/561.1, 423/61, 267, 275
See application file for complete search history.

(56) References Cited

U.S. PATENT DOCUMENTS 3,705,020 A * 12/1972 Nachtman ..... 75/231
4,676,970 A * 6/1987 Todd et al. ..... 423/561.1
5,288,792 A 2/1994 Buxbaum ..... 252/25
5,768,678 A 6/1998 Chopra et al. ..... 419/37
5,936,170 A * 8/1999 Hanlin et al. ..... 75/246

FOREIGN PATENT DOCUMENTS

EP 0 183 666 * 6/1986
JP 11-021659 1/1999
KR 2001008459 2/2001

OTHER PUBLICATIONS

Derwent Abstract accession No. 2003-338904, for KR 2002066863 A, published Aug. 21, 2002.*
Derwent Abstract accession No. 2003-338905, for KR 2002066864 A, published Aug. 21, 2002.*
Merriam-Webster's Collegiate Dictionary, 10th Edition, Merriam-Webster, Inc., p. 749, (1998).

* cited by examiner

*Primary Examiner*—Stuart L. Hendrickson
*Assistant Examiner*—Ardith E. Hertzog
(74) *Attorney, Agent, or Firm*—Marshall, Gerstein & Borun LLP

(57) ABSTRACT

Disclosed herein are compositions of a manganese sulfide (MnS) compound useful as additives for making a sintered product. Also disclosed herein is a method of making the composistions in which molybdenum (Mo) or Fe—Mo is added to the MnS compound to improve machinability and to obtain a more stable MnS compound, thereby reducing any change in weight and size in a sintering process. The compositions can suppress erosion of parts in a sintering furnace during a sintering process, prevent sooting on a surface of the sintered product from occurring, and enhance resistance to moisture in the air to keep the sintered product in the air for a long time.

13 Claims, 5 Drawing Sheets

METHOD OF MAKING MANGANESE SULFIDE COMPOSITIONS

CROSS-REFERENCE TO RELATED APPLICATION

This is a division of U.S. patent application Ser. No. 10/219,026 filed Aug. 14, 2002, now abandoned, the disclosure of which is incorporated herein by reference.

BACKGROUND OF THE DISCLOSURE

1. Field of the Disclosure

The disclosure relates to compositions of manganese sulfide (MnS) compounds useful as additives for making a sintered product to enhance machinability and, more particularly, to compositions of a MnS compound useful as additives for making a sintered product that can be preserved for a long time by enhancing resistance to moisture in the air.

2. Discussion of the Related Art

Generally, manganese sulfide (MnS) is a kind of a metal sulfide and is used as an additive to raw materials to enhance machinability in making a sintered product. The MnS may be used as a solid lubricant.

Currently manufactured MnS is a pure form of MnS, which is manufactured so that sulfur (S) rather than manganese (Mn) is in excess. Surplus sulfur reacts with oxygen, zinc, and the like under the atmosphere of a sintering furnace during the sintering process, resulting in problems. For example, excess sulfur erodes mesh belts of heat-resistant steel, muffle, or fireproof material, which is formed in the furnace, and may remain on a surface of the product to cause sooting.

To solve such problems, to make up for heat loss in the manufacturing process, and to improve productivity, a manganese sulfide compound and its method of production have been disclosed in U.S. Pat. No. 5,768,678. In this patent, a MnS compound of Fe—Mn is manufactured. In this case, since a considerable amount of sulfur remains in excess, the problems described herein still occur in the sintering process.

Recently, attempts to manufacture a metal sulfide by mixing sulfur with metal using a mechanical-chemical method have been made in Korean Patent Applications Nos. 1999-0026303, 2001-0007298, and 2001-0007299. In case of MnS manufactured by this method, excess sulfur has been considerably reduced. However, a problem still remains in the sintering process. Also, since such MnS has hygroscopic that absorbs moisture in the air, problems occur in preservation and use after manufacturing it.

SUMMARY OF THE DISCLOSURE

Accordingly, the disclosure is directed to compositions of a MnS compound useful as additives for making a sintered product that substantially obviate one or more problems due to limitations and disadvantages of the related art.

The disclosure provides compositions of MnS useful as additives for sintered products in which molybdenum (Mo) or Fe—Mo is added to MnS to obtain a MnS compound that is more stable than pure MnS, thereby reducing changes in weight and size in a sintering process.

The disclosure also provides compositions of MnS useful as additives for making sintered products that suppress erosion of parts in a sintering furnace during a sintering process, preventing sooting on a surface of the sintered product from occurring, and enhancing resistance to moisture in the air to keep MnS in the air for a long time.

Additional advantages, objectives, and features of the disclosure are set forth in part in the description which follows and may become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objectives and other advantages and in accordance with the purpose of the disclosure, as embodied and broadly described herein, compositions of a manganese sulfide (MnS) compound useful as additives for making a sintered product are characterized in that molybdenum (Mo) or Fe—Mo is added to the MnS compound to improve machinability.

Both the foregoing general description and the following detailed description are exemplary and explanatory.

BRIEF DESCRIPTION OF THE DRAWINGS

The accompanying drawings are included to provide a further understanding of the disclosure and illustrate embodiments of the disclosure. In the drawings.

DETAILED DESCRIPTION

Reference will now be made in detail to preferred embodiments of the disclosure, examples of which are illustrated in the accompanying drawings. Wherever possible, the same reference numbers will be used throughout the drawings to refer to the same or like parts.

Mo is independently added to a MnS compound in the range of about 0.5 wt % to about 10 wt % (the other 99.5 wt % to about 90 wt % is MnS). If Mo is added to the MnS compound, a decrease rate in weight during sintering is smaller than if Fe is added to the MnS compound. This is because Mo forms $MoS_2$ so that Mo interacts with excess sulfur and the stability of Mn is greatly improved.

If a Mo—Fe compound is added to the MnS compound, Fe is in the range of about 4 wt % to about 8 wt % of the composition and Mo in the range of about 0.5 wt % to about 15 wt %, preferably, about 1.0 wt % to about 6.0 wt %, of the composition. In this case, stability of the MnS compound can be improved. If the Mo concentration is less than 0.5 wt %, the MnS compound is more stable than pure MnS, but a relatively great decrease rate in weight is generated. If Mo is in the range of about 6 wt % to about 15 wt %, the MnS compound has relatively excellent characteristics but it is not economical due to the expense of Mo.

Therefore, the preferred MnS compound is obtained by adding Mo of about 0.5 wt % to about 15 wt % to Fe of about 4 wt % to about 8 wt %. More preferably, Mo contained in the composition is in the range of about 1.0 wt % to about 6.0 wt %.

EXAMPLE 1

Figure 1:
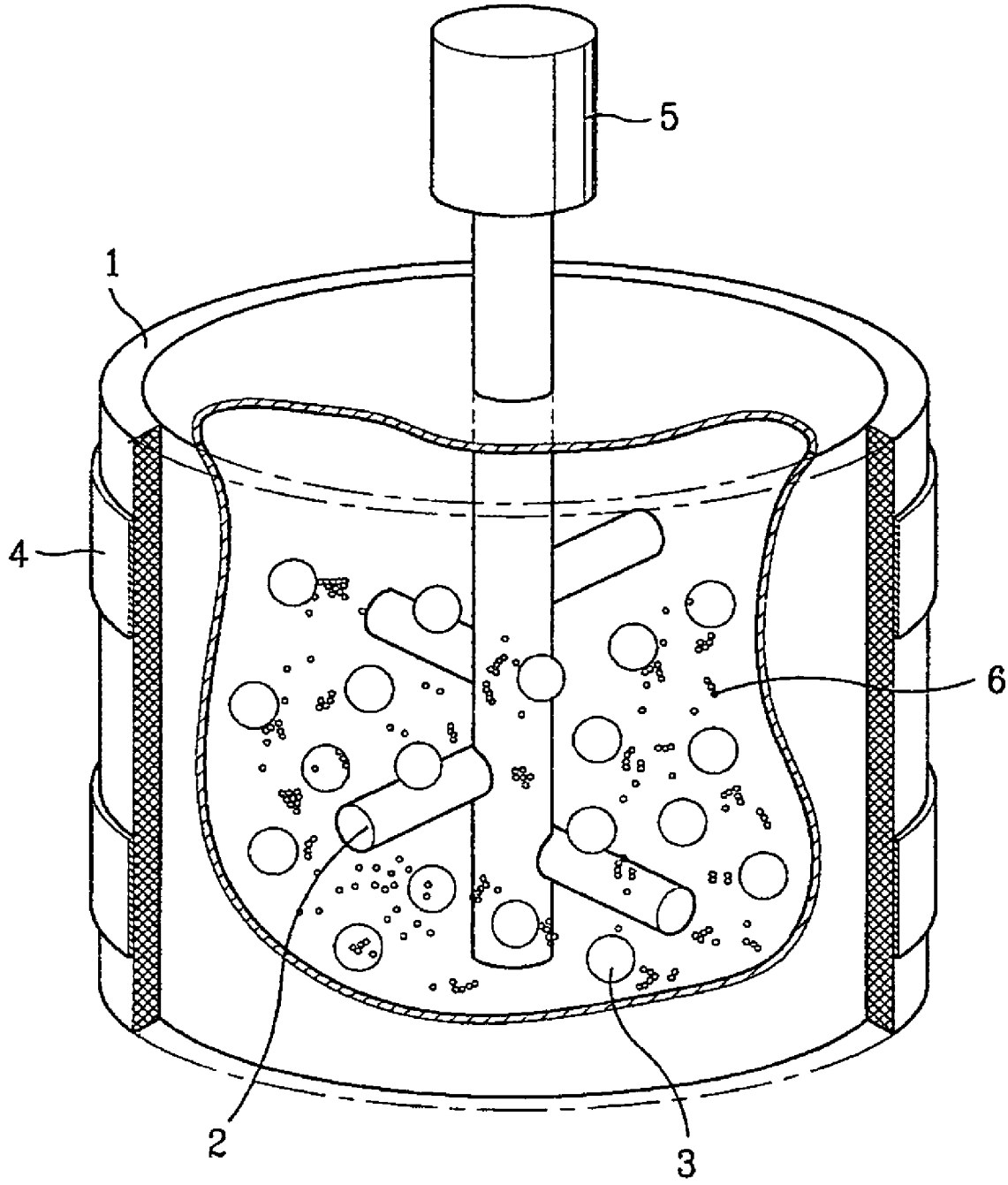
FIG. 1 illustrates a device for mixing a MnS compound.
Figure 2:
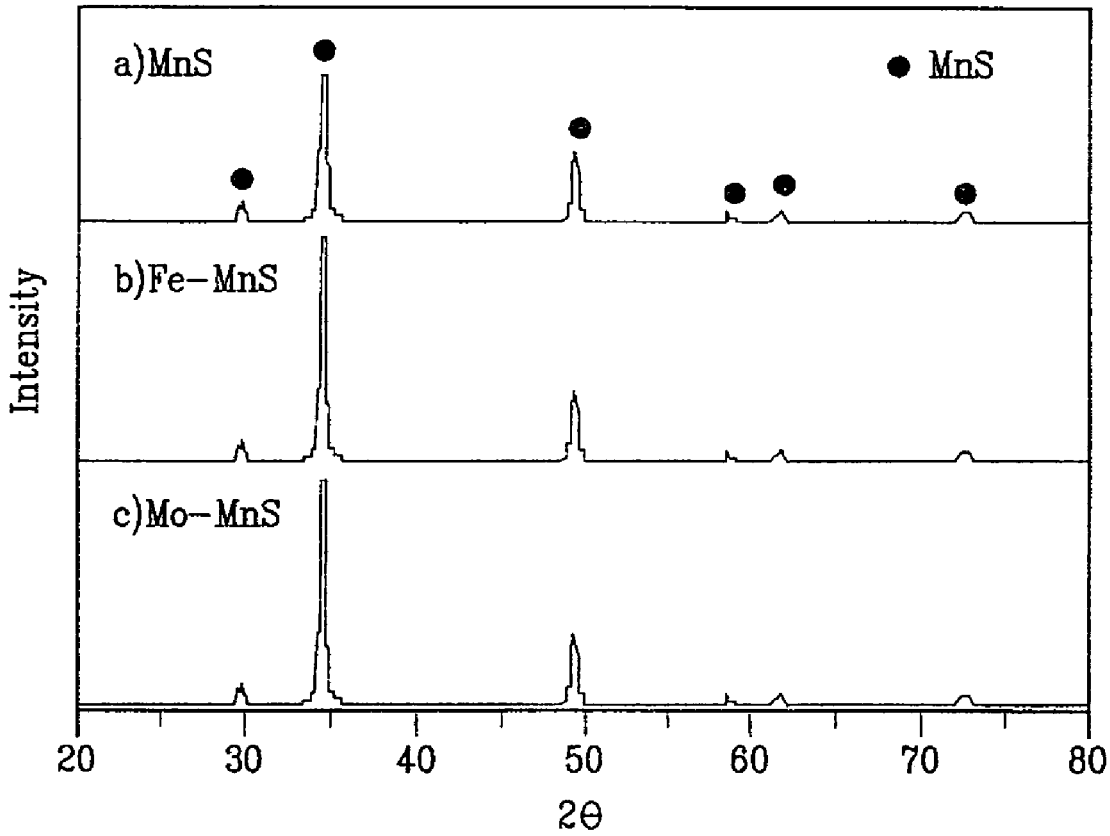
FIG. 2 illustrates peaks of a phase analysis.
Figure 3:
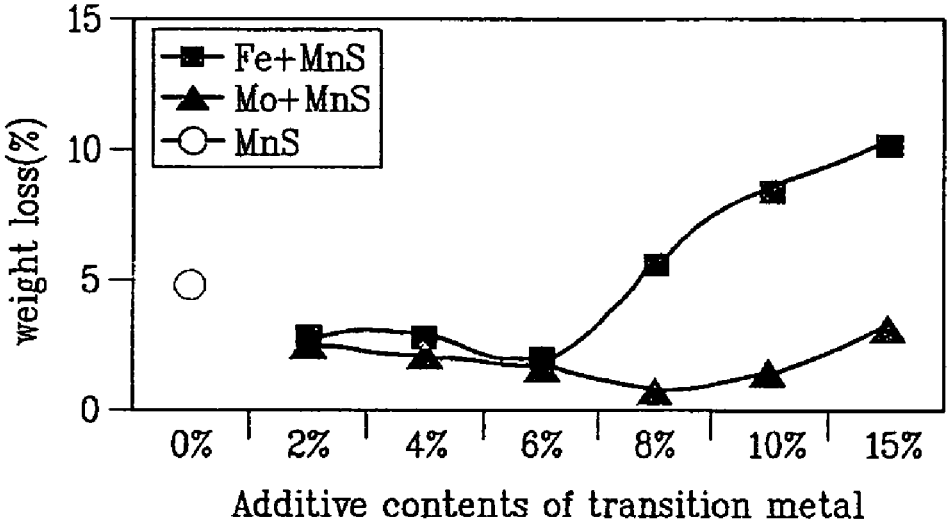
FIG. 3 is a graph illustrating changes of a decrease rate in weight after passing through a sintering furnace when Mo is added to a MnS compound.

Mo—Fe powders of 0 wt %, 2.0 wt %, 4.0 wt %, 6.0 wt %, 8.0 wt %, 10.0 wt %, and 15.0 wt % were respectively added to a MnS powder, and 3.0 kg were weighed to obtain a composition ratio of 1:1 between Mo—Fe powder and sulfur. As shown in FIG. 1, MnS 6 containing Mo and steel balls 3 (20 kg) were put in a rigid container 1 of 15 liters volume. The rigid container 1 was provided with a rotary shaft 2 and a motor 5 rotated at 600 rpm for thirty minutes while heating the surface of the rigid container 1 and temporarily heating the same up to 400° C. by a heater 4 or cooling the same to adjust heat energy. As a result, the MnS compound was manufactured and is used in the following experiments.

Phase Analysis and Component Analysis

X-ray diffraction (XRD) analysis and X-ray fluorescent (XRF) analysis were carried out for phase analysis and component analysis of the MnS compound. As a result, all peaks of the XRD were observed as MnS phases. No difference between the related art MnS and an improved MnS compound of the disclosure was observed. To check whether an additive remained, a component of the MnS compound was analyzed by XRF analysis. The analyzed result of the component of the MnS powder showed the presence of Fe and Mo (see Table 1). Therefore, Fe and Mo added to the improved MnS compound did not affect the crystalline structure of the sulfide.

Test of Color Change

To test stability, 100 g of each of an improved MnS compound and a pure MnS were respectively weighed in a ceramic crucible and maintained in a sintering furnace under a reducing atmosphere at 1120° C. for one hour. Mo of about 2 wt % to about 10 wt % and Fe of about 4 wt % to about 8 wt % were added to the improved MnS compound. Decrease in weight of the powder and color change in the crucible were tested. The result of the test indicated that a pollution level (color change) in the crucible containing the improved MnS compound was reduced as compared with the related art pure MnS compound. This means that a more stable MnS can be manufactured by adding Mo and Fe having the above compositions to the existing pure MnS. On the other hand, if Mo of 8 wt % or greater and Fe of 6 wt % or greater are added to the MnS powder, the pollution level increases and a decrease rate in weight of the MnS powder increases. This is because that the stable MnS arises from Mo and Fe. Accordingly, it is preferable that Mo of about 1.0 wt % to about 6.0 wt % is used.

Also, if Mo instead of Fe is added to the MnS compound, the decrease rate in weight becomes smaller. This is because that Mo forms $MOS_2$ to interact with excess sulfur to improve stability of Mn.

Test of the Hygroscopicity

Figure 4:
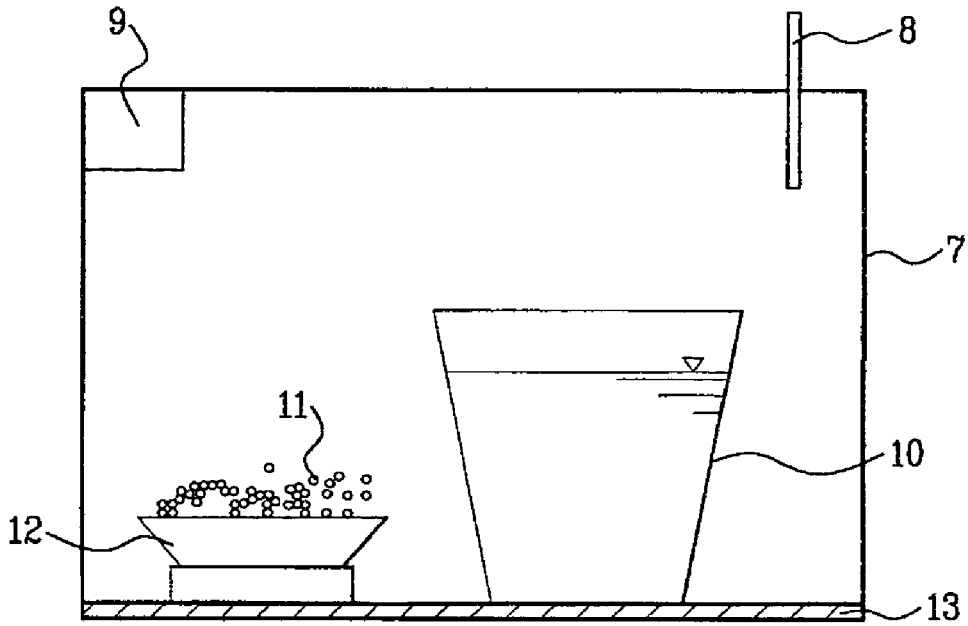
FIG. 4 illustrates a device for testing hygroscopicity.
Figure 5:
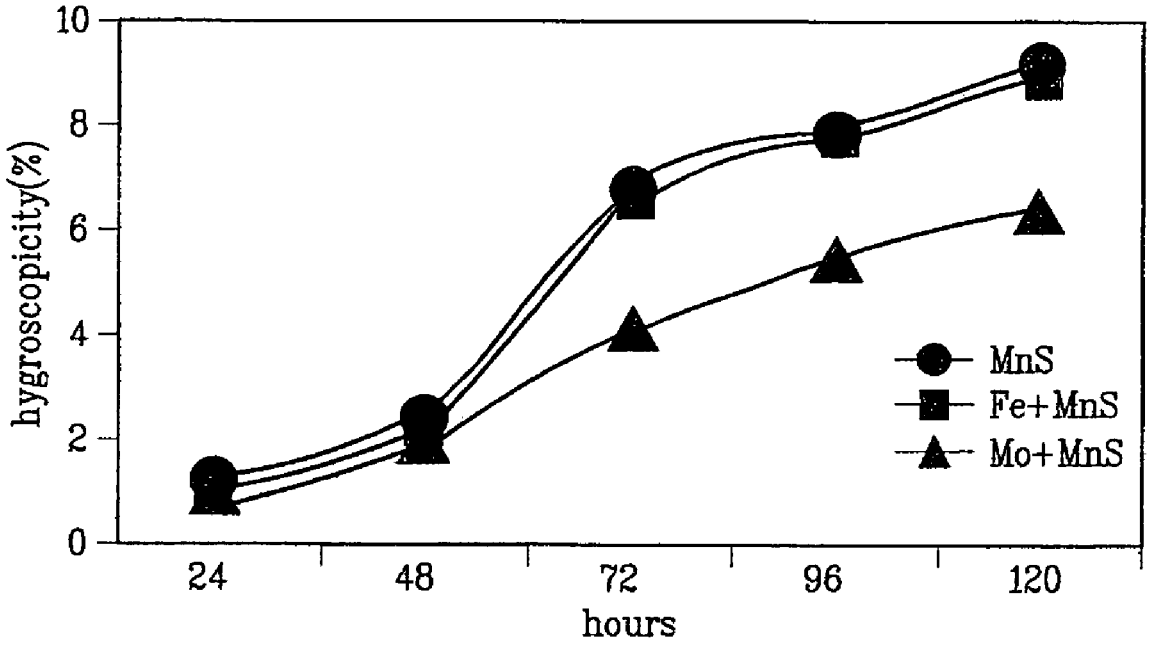
FIG. 5 is a graph illustrating change in hygroscopic amount after the elapse of time.

To test the hygroscopicity in the air, as shown in FIG. 4, a thermometer 8 and a timer 9 were set up at the upper part of a tank 7, and a container 10 with water and a glass saucer 12 for MnS 11 were disposed at the lower part of the tank 7. A device with a temperature controller 13 was additionally provided at the bottom of the tank. FIG. 5 shows the test result of the hygroscopicity by measuring the respective increased amounts of the weight of 100 g of MnS and MnS+Fe of the related art and MnS+Mo of the disclosure on the glass saucer 12 after the lapse of time. The pure MnS and MnS+Fe, as shown in FIG. 5, came to have more hygroscopicity, after the lapse of time, compared to the improved MnS compound (MnS+Mo). Moreover, after the lapse of time, not only the above difference between the related art and the compound components increased, but the color of a mass of a sulfide changed to dark red.

Test of Stability

To test stability in the practical product, MnS of 0.5 wt % according to the prior art and according to the disclosure were added to a sintered steel having compositions of Fe-4Ni-0.4Mo-1.5Cu-0.8C. The resultant product was compacted and sintered at the same density of 6.8g/cm$^3$ to measure the rate of weight loss and any dimensional change.

Figure 6:
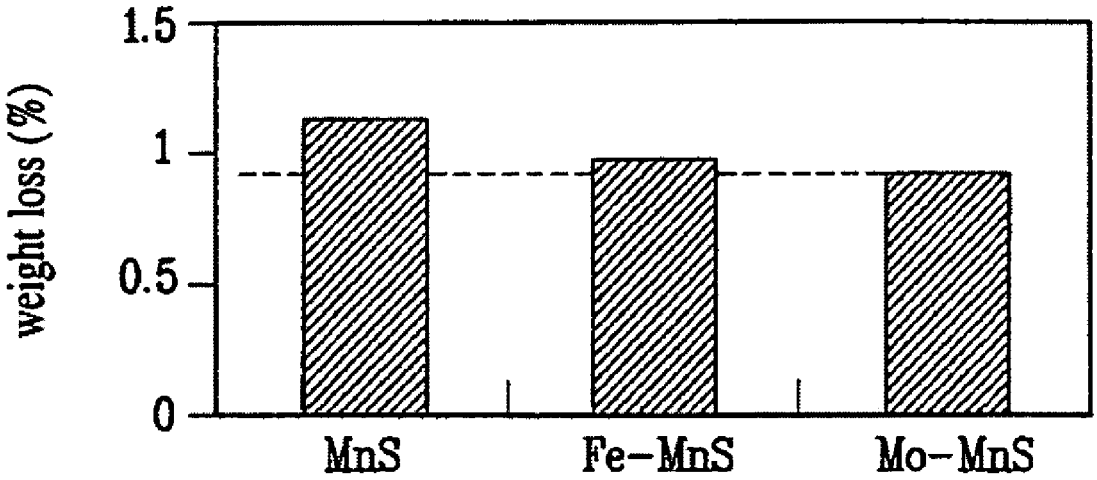
FIG. 6 is a graph illustrating a change rate in weight when a MnS compound powder of 0.5% is added to a sintered steel.
Figure 7:
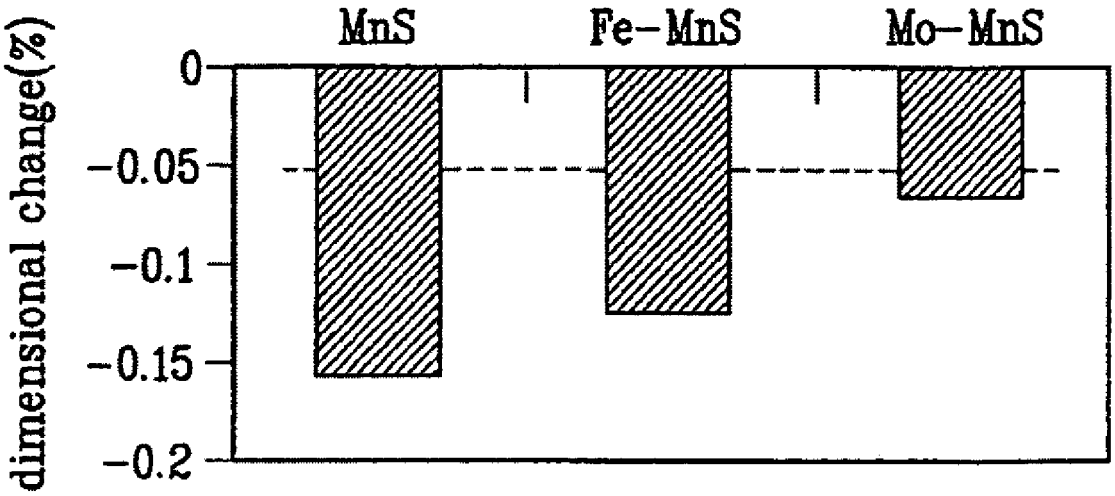
FIG. 7 is a graph illustrating a dimensional change when a MnS compound powder of 0.5% is added to a sintered steel.

As a result, as shown in FIGS. 6 and 7, a smaller decrease in weight loss and a more stable dimensional change were indicated in the MnS compound of the disclosure. Since the MnS compound of the disclosure had a small change in size after addition of MnS, an originally manufactured molding was used until the final product is completed. This is very important in the field of powder metallurgy of which size of the final product is determined by molding.

EXAMPLE 2

While Mo and Fe of transition metals were respectively added and tested in the Example 1, in Example 2 Mo and Fe were simultaneously added to manufacture a stable metallic compound. Fe was added at a greater amount than an amount of the relatively expensive Mo.

The content of Fe was fixed at 6% corresponding to the range having the most excellent characteristic in Example 1. Mo was added by each of 2 wt %, 4 wt %, 6 wt %, 8 wt %, and 10 wt % so that the MnS compound was manufactured by the same process as that of Example 1. Then, the remainder of the MnS compound after passing through the sintering furnace at the powder state was tested by the same method as that of Example 1. The result of the test is shown in FIG. 8.

Figure 8:
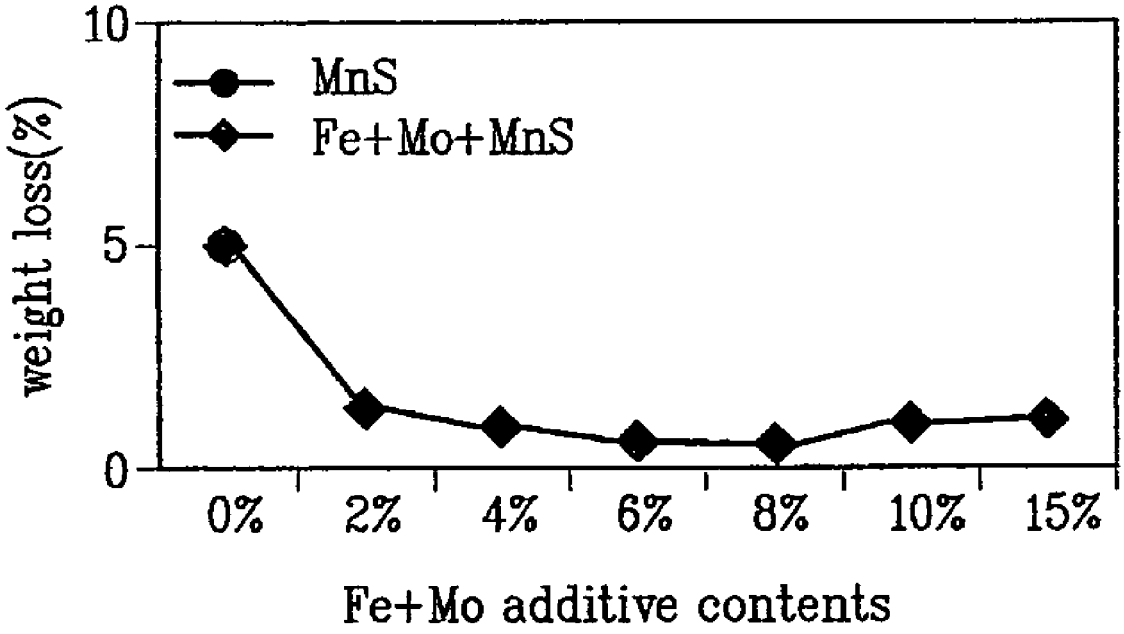
FIG. 8 is a graph illustrating a weight loss (%) after passing through a sintering furnace when Mo and Fe are simultaneously added to a MnS compound.

As will be apparent of it from FIG. 8, the stability of MnS was remarkably improved even if Fe and Mo were simultaneously added to the MnS compound. If Mo is added to the MnS compound at a small content (0.5 wt % or less), a relatively great decrease rate in weight was indicated, even if the MnS compound of the Example 2 is more stable than the pure MnS. However, in this case, a problem arose in that the practical advantages were reduced. If Mo of about 6 wt % to about 15 wt % is added to the MnS compound, excellent characteristics can be obtained but it is not economical due to its expense. Therefore, the preferred composition of the MnS compound includes Fe of about 4 wt % to about 8 wt % and Mo of about 0.5 wt % to about 15 wt %. More preferably, the MnS compound includes Fe of about 4 wt % to about 8 wt % and Mo of about 1.0 wt % to about 6.0 wt %.

TABLE I

| | MnS | Fe—MnS | Mo—MnS |
|---|---|---|---|
| Mn | 62.9 | 59.7 | 57.1 |
| S | 36.0 | 33.5 | 39.6 |
| Fe | 0.63 | 6.81 | 0.58 |
| Cu | | | |
| Mo | | | 6.2 |

TABLE I-continued

| | MnS | Fe—MnS | Mo—MnS |
|---|---|---|---|
| O | 0.32 | 0.3 | 0.27 |
| C | 0.15 | 0.14 | 0.18 |

The compositions of MnS compound according to the disclosure have the following advantages.

Since the compositions of the MnS compound, such as Fe and Mo, are useful additives for making a sintered product, stability of the product can be enhanced and a decreased rate of weight loss is demonstrated. Also, since adverse effects to the product are reduced, the life span of the sintering furnace increases and discoloration of the product are reduced. Resistance to oxidation increases due to low hygroscopicity. This reduces problems related to packing and storage of the product. Enhanced dimensional stability can enable the product to be manufactured without newly making a mold and can enhance accuracy of the manufacturing process.

What is claimed is:

1. A method of making a manganese sulfide composition, the method comprising combining molybdenum (Mo) and optionally iron (Fe) with manganese sulfide, and simultaneously heating to a temperature of up to 400° C. and mixing the combination to form the composition.

2. The method of claim 1, wherein molybdenum is present in the composition in an amount of about 0.5 wt. % to about 10 wt. %, based on the total weight of the composition.

3. The method of claim 2, wherein molybdenum is present in the composition in an amount of about 2 wt. %, based on the total weight of the composition.

4. The method of claim 2, wherein molybdenum is present in the composition in an amount of about 4 wt. %, based on the total weight of the composition.

5. The method of claim 2, wherein molybdenum is present in the composition in an amount of about 6 wt. %, based on the total weight of the composition.

6. The method of claim 2, wherein molybdenum is present in the composition in an amount of about 8 wt. %, based on the total weight of the composition.

7. The method of claim 2, wherein molybdenum is present in the composition in an amount of about 10 wt. %, based on the total weight of the composition.

8. The method of claim 1, wherein molybdenum is present in the composition in an amount of about 0.5 wt. % to about 15 wt. %, based on the total weight of the composition, and iron is present in the composition in an amount of about 4 wt. % to about 8 wt. %, based on the total weight of the composition.

9. The method of claim 8, wherein molybdenum is present in the composition in an amount of about 1 wt. % to about 6 wt. %, based on the total weight of the composition.

10. The method of claim 1, comprising simultaneously combining molybdenum and iron with manganese sulfide.

11. The method of claim 10, wherein molybdenum is present in the composition in an amount of about 0.5 wt. % to about 15 wt. %, based on the total weight of the composition, and iron is present in the composition in an amount of about 4 wt. % to about 8 wt. %, based on the total weight of the composition.

12. The method of claim 11, wherein molybdenum is present in the composition in an amount of about 1 wt. % to about 6 wt. %, based on the total weight of the composition.

13. The method of claim 10, wherein iron is present in the composition in an amount of about 6 wt. %, based on the total weight of the composition.

* * * * *